US011154127B2

(12) United States Patent
Maravilla et al.

(10) Patent No.: US 11,154,127 B2
(45) Date of Patent: Oct. 26, 2021

(54) CLAMSHELL PACK

(71) Applicant: Exxel Outdoors, LLC, Boulder, CO (US)

(72) Inventors: Daniel John Maravilla, Thousand Oaks, CA (US); Anthony Trent Valladares, Thousand Oaks, CA (US)

(73) Assignee: Exxel Outdoors, LLC, Broomfield, CO (US)

( * ) Notice: Subject to any disclaimer, the term of this patent is extended or adjusted under 35 U.S.C. 154(b) by 0 days.

(21) Appl. No.: 16/567,637

(22) Filed: Sep. 11, 2019

(65) Prior Publication Data

US 2020/0077772 A1 Mar. 12, 2020

Related U.S. Application Data

(60) Provisional application No. 62/729,802, filed on Sep. 11, 2018.

(51) Int. Cl.
*A45F 3/04* (2006.01)

(52) U.S. Cl.
CPC ..... *A45F 3/047* (2013.01)

(58) Field of Classification Search
CPC ..... A45F 3/04; A45F 3/047; Y10S 190/903
See application file for complete search history.

(56) References Cited

U.S. PATENT DOCUMENTS 2,827,096 A 3/1958 Hinson
3,777,862 A * 12/1973 Zipper ..... A45C 3/004 190/107
4,403,638 A 9/1983 Baum
4,925,064 A * 5/1990 Comora ..... A45F 3/04 224/155
5,447,261 A * 9/1995 Mitomi ..... A45C 5/14 190/110
5,810,166 A * 9/1998 Weinreb ..... A45C 13/103 190/903
6,050,374 A 4/2000 Johnston
6,179,186 B1 * 1/2001 Blanking ..... A45F 3/04 224/153
6,276,501 B1 * 8/2001 Tong ..... A45C 3/004 190/107
6,394,328 B1 * 5/2002 Zakarin ..... A45F 3/04 150/108
6,474,524 B1 * 11/2002 Ivarson ..... A45F 3/04 224/637
6,880,685 B2 * 4/2005 Fenton ..... A45C 5/02 150/127
7,165,705 B2 * 1/2007 Haro ..... A45C 13/04 224/627
9,320,341 B2 4/2016 Majeau
10,413,045 B2 * 9/2019 Crisp ..... A45F 3/04
(Continued)

*Primary Examiner* — Brian D Nash
(74) *Attorney, Agent, or Firm* — Stinson LLP

(57) ABSTRACT

A pack enables objects stored therein to be accessed easily and efficiently. The pack includes a rear portion including one or more first sidewalls, and a front portion including one or more second sidewalls. Each first sidewall has a generally convex configuration, and each second sidewall has a generally concave configuration that complements the convex configuration of the first sidewalls. The second sidewalls are extendable generally along the first sidewalls to couple the front portion to the rear portion.

19 Claims, 7 Drawing Sheets

(56) References Cited

U.S. PATENT DOCUMENTS

| | | | | |
|---|---|---|---|---|
| 10,856,634 | B2 * | 12/2020 | Sturm | A45F 5/021 |
| 2006/0144885 | A1 * | 7/2006 | Smeuninx | A45F 3/047<br>224/629 |
| 2009/0266727 | A1 * | 10/2009 | Fair | A45C 11/38<br>206/316.2 |
| 2010/0282809 | A1 * | 11/2010 | Scicluna | A45C 13/02<br>224/653 |
| 2011/0315589 | A1 * | 12/2011 | Thomas | G06F 1/1628<br>206/521 |
| 2012/0267409 | A1 | 10/2012 | Chavis | |
| 2014/0326560 | A1 * | 11/2014 | Bergh | A45C 13/02<br>190/110 |
| 2015/0068933 | A1 * | 3/2015 | So | A45C 11/38<br>206/316.1 |
| 2015/0344182 | A1 * | 12/2015 | Malin | B65D 25/10<br>206/299 |
| 2016/0174691 | A1 * | 6/2016 | Chapuis | A45F 3/04<br>224/605 |
| 2017/0188673 | A1 * | 7/2017 | Jose | A45C 5/03 |
| 2017/0295911 | A1 * | 10/2017 | Scicluna | A45F 3/04 |
| 2019/0008264 | A1 * | 1/2019 | Furstenburg | A45F 3/04 |
| 2020/0037734 | A1 * | 2/2020 | Ortlieb | A45F 3/12 |
| 2020/0085175 | A1 * | 3/2020 | Cotirla | A45F 4/02 |

* cited by examiner

CLAMSHELL PACK

CROSS-REFERENCE TO RELATED APPLICATION

This application claims the benefit of U.S. Provisional Application No. 62/729,802, filed Sep. 11, 2018.

BACKGROUND

Packs such as backpacks used to store and transport camera equipment typically have cover that is zipped onto to a housing. Known covers have to be completely unzipped to provide access to the equipment, making use of the backpack more time consuming when retrieving or storing an object in the backpack.

SUMMARY

Aspects of the disclosure enable objects stored in a pack to be accessed easily and efficiently. In one aspect, a pack is provided. The pack includes a rear portion including one or more first sidewalls, and a front portion including one or more second sidewalls. Each first sidewall has a generally convex configuration, and each second sidewall has a generally concave configuration that complements the generally convex configuration of the first sidewalls. The second sidewalls are extendable generally along the first sidewalls to couple the front portion to the rear portion.

In another aspect, a panel is provided for use in fabricating a pack. The panel includes a first portion including a first body and a pair of first side sections extending laterally from the first body, and a second portion including a second body and a pair of second side sections extending from the second body. Each first side section has a generally convex configuration, and each second side section has a generally concave configuration that complements the generally convex configuration of the first side sections. The second portion is hingably coupled to the first portion.

In yet another aspect, a method of manufacturing a pack is provided for use in storing camera equipment. The method includes providing a rear portion including a pair of first sidewalls, and providing a front portion including a pair of second sidewalls. Each first sidewalls has a generally convex configuration, and each second sidewall has a generally concave configuration that complements the generally convex configuration of the first sidewalls. The front portion is hingably coupled to the front portion such that the pack is moveable between an open configuration and a closed configuration. The second sidewalls extend generally along the first sidewalls when the pack is in the closed configuration.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

The subject matter described herein relates generally to packs and, more specifically, to a clamshell pack. Examples of the disclosure may be used, for example, to provide access to an interior of a pack without completely unzipping a cover. In some examples, the pack includes a base or rear portion including one or more first side sections, and a cover or front portion including one or more second side sections. The rear portion has an edge with a first S-shaped configuration, and the front portion has an edge with a second S-shaped configuration that complements the first S-shaped configuration.

Figure 1:
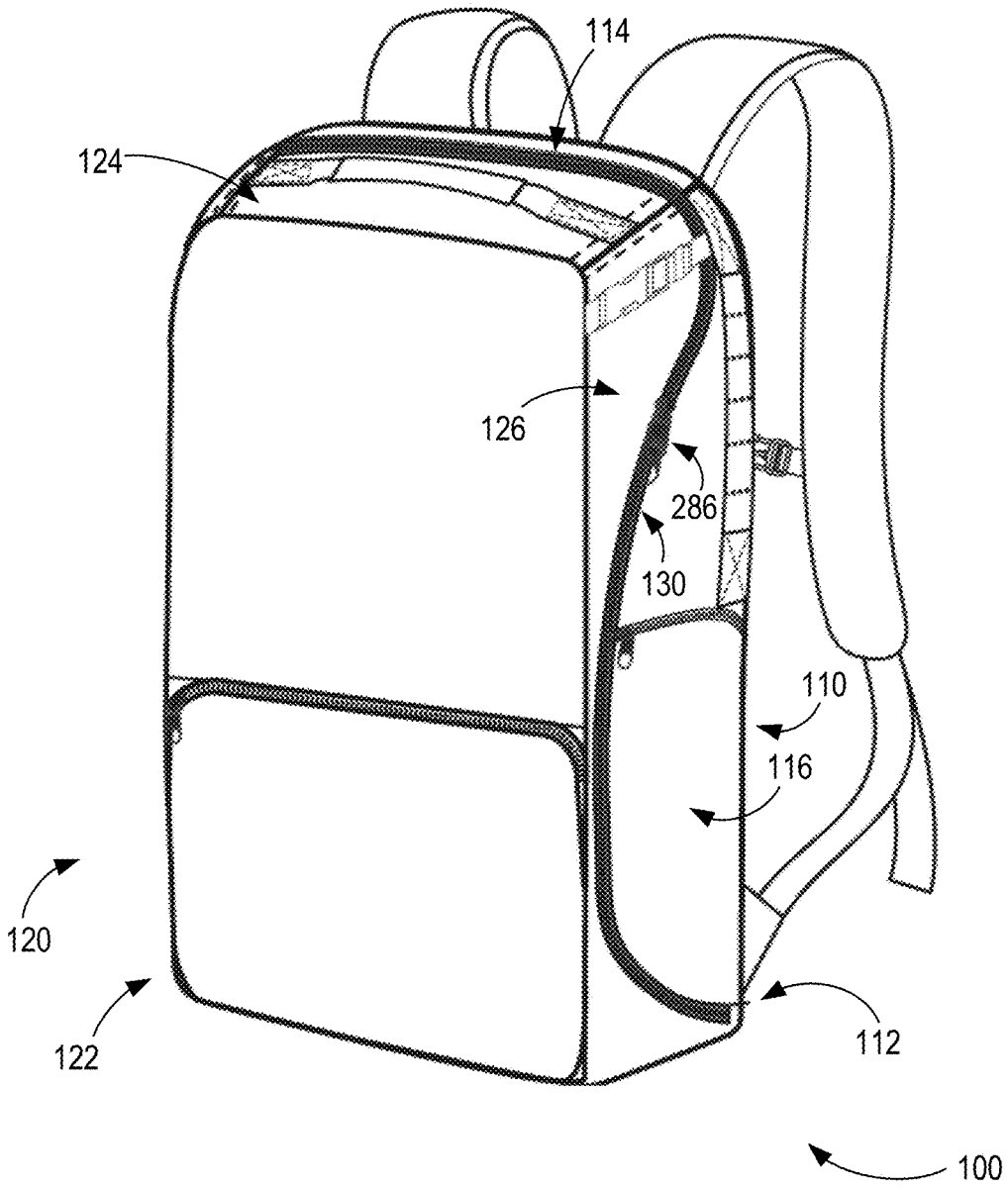
FIG. 1 is a perspective view of an example clamshell pack.

FIG. 1 shows an example clamshell pack or pack 100. The pack 100 includes a base or rear portion 110 including a lower section 112, an upper wall 114, and a pair of sidewalls 116 extending between the lower section 112 and upper wall 114. As shown in FIG. 1, the upper wall 114 may have a generally concave or curved configuration and the sidewalls 116 may have a generally convex or curved configuration such that the rear portion 110 has a first S-shaped configuration.

In some examples, a cover or front portion 120 is coupled to the rear portion 110 such that the pack 100 is moveable between an open configuration and a closed configuration. The front portion 120 may include a lower section 122, an upper wall 124, and/or a pair of sidewalls 126 extending between the lower section 122 and upper wall 124. As shown in FIG. 1, the upper wall 124 may have a generally convex or curved configuration and the sidewalls 126 may have a generally concave or curved configuration such that the front portion 120 has a second S-shaped configuration that complements the first S-shaped configuration of the rear portion 110.

In some examples, the pack 100 includes a coupling mechanism 130 coupling at least a section of the front portion 120 to a section of the rear portion 110. A curved, continuous zipper on three sides of the pack 100 may allow the pack 100 to be opened. For example, the upper wall 124 and/or sidewalls 126 of the front portion 120 may be aligned with the upper wall 114 and/or sidewalls 116 of the rear portion 110 and coupled thereto, as shown in FIG. 1, using a coupling mechanism 130 extending along the upper wall 114 and/or sidewalls 116 of the rear portion 110 and/or the upper wall 124 and/or sidewalls 126 of the front portion 120. The coupling mechanism 130 may include any type of fastener, such as zippers, buttons, snaps, and/or hook-and-loop fasteners.

Figure 2:
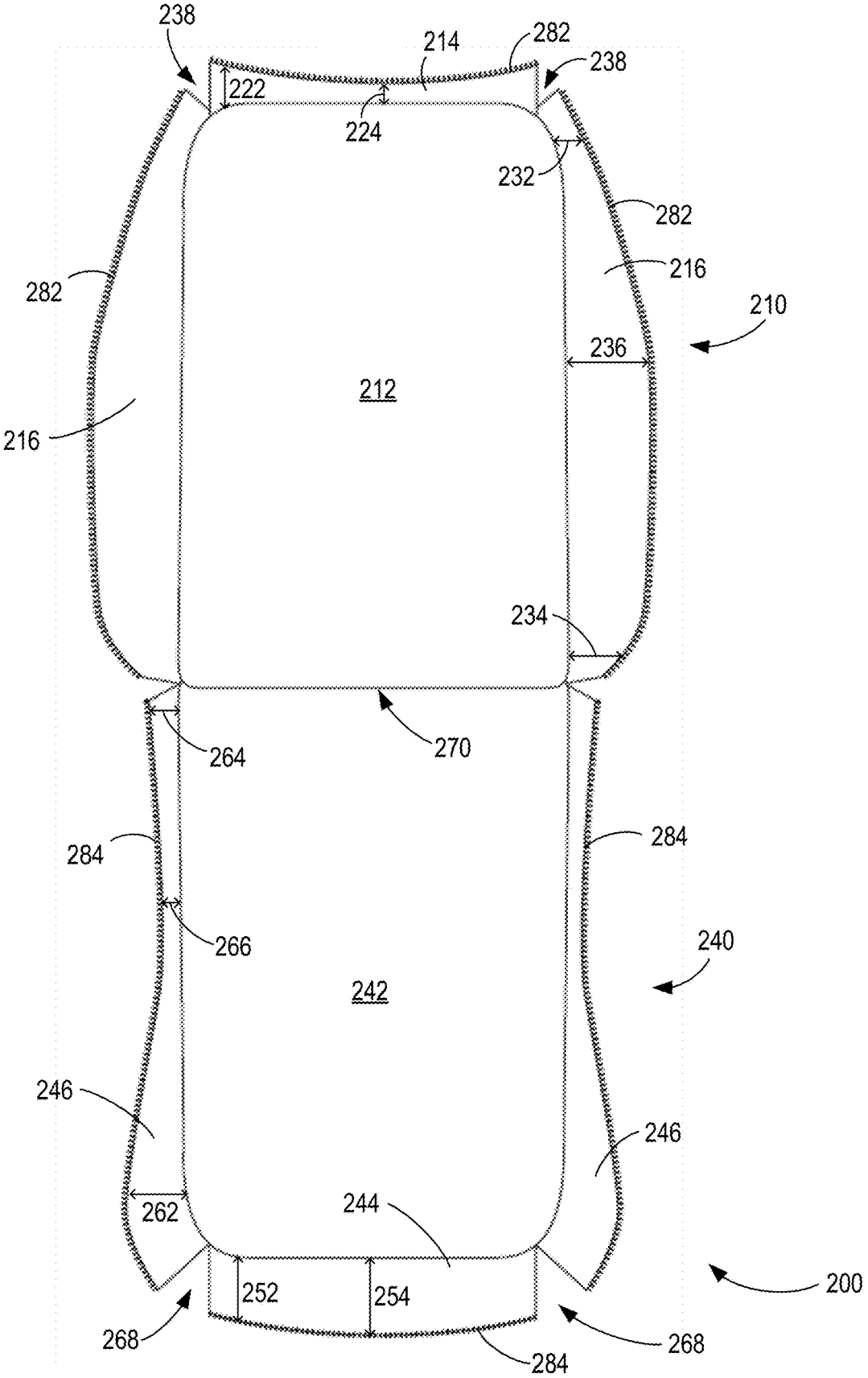
FIG. 2 is a plan view of a fabric that may be used to fabricate a pack, such as the clamshell pack shown in FIG. 1.

FIG. 2 shows a panel or fabric 200 that may be used to fabricate the pack 100. The fabric 200 may include a first portion 210 including a body 212, an end section 214 extending generally longitudinally from the body 212, and a pair of side sections 216 extending generally laterally from the body 212. In some examples, the end section 214 has a first height 222 towards the lateral sides (e.g., proximate side sections 216) and a second height 224 less than the first height 222 towards the middle such that the end section 214 has a generally concave or curved configuration. Additionally, the side sections 216 may have a first height 232 towards a first longitudinal end (e.g., proximate the end section 214), a second height 234 towards a second longitudinal end opposite the first longitudinal end, and a third height 236 greater than the first height 232 and second height 234 between the first longitudinal end and second longitudinal end such that the side sections 216 each have a generally convex or curved configuration. The first height 222 of the end section 214 may be the same as or substantially similar to the first height 232 of the side sections 216 such that the transition therebetween is smooth or continuous.

Figure 3:
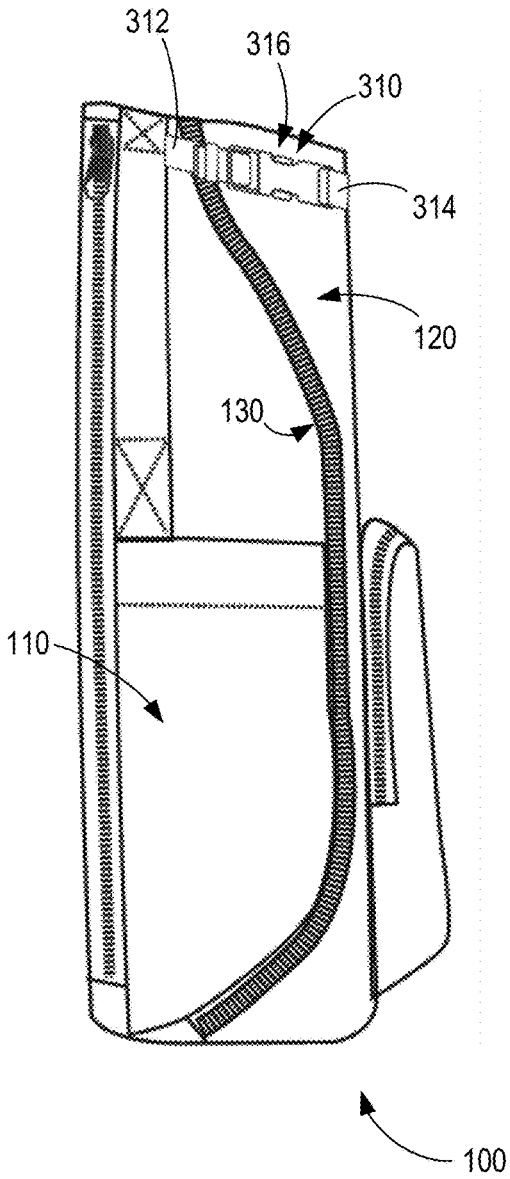
FIG. 3 is a left side view of the clamshell pack shown in FIG. 1.
Figure 4:
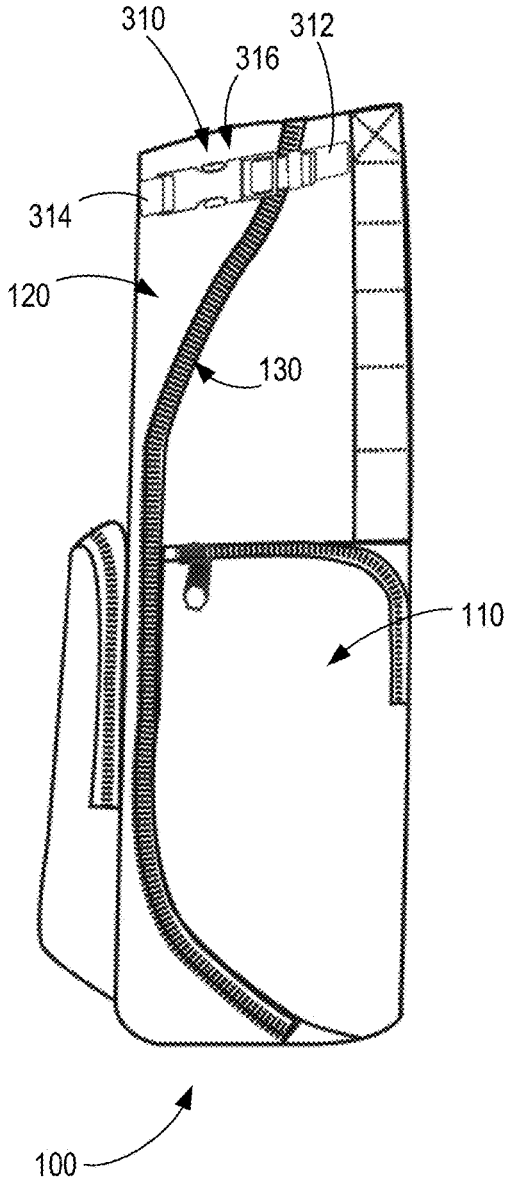
FIG. 4 is a right side view of the clamshell pack shown in FIG. 1.

The first portion 210 may be used to fabricate the rear portion 110 of the pack 100. For example, the end section 214 and side sections 216 may be turned or rotated to extend generally perpendicular to the body 212 such that the end section 214 and side sections 216 form the upper wall 114 and sidewalls 116 of the rear portion 110. The end section 214 and side sections 216 may be coupled to each other to form a seam at each interface 238 therebetween. As shown in FIGS. 3 and 4, the sidewalls 116 of the rear portion 110 extend a first distance (e.g., first height 232) proximate the upper wall 114, a second distance (e.g., second height 234) proximate the lower section 112, and a third distance (e.g., third height 236) at a midsection therebetween.

Referring back to FIG. 2, the fabric 200 may include a second portion 240 including a body 242, an end section 244 extending generally longitudinally from the body 242 (e.g., in a direction opposite the end section 214), and a pair of side sections 246 extending generally laterally from the body 242. In some examples, the end section 244 has a first height 252 towards the lateral sides (e.g., proximate side sections 246) and a second height 254 greater than the first height 252 towards the middle such that the end section 244 has a generally convex or curved configuration that complements the generally concave configuration of the end section 214. Additionally, the side sections 246 may have a first height 262 towards a first longitudinal end (e.g., proximate the end section 244), a second height 264 towards a second longitudinal end opposite the first longitudinal end, and a third height 266 less than the first height 262 and second height 264 between the first longitudinal end and second longitudinal end such that the side sections 246 each have a generally concave or curved configuration that complements the generally convex configuration of the side sections 216. The first height 252 of the end section 244 may be the same as or substantially similar to the first height 262 of the side sections 246 such that the transition therebetween is smooth or continuous.

The second portion 240 may be used to fabricate the front portion 120 of the pack 100. For example, the end section 244 and side sections 246 may be turned or rotated to extend generally perpendicular to the body 242 such that the end section 244 and side sections 246 form the upper wall 124 and sidewalls 126 of the front portion 120. The end section 244 and side sections 246 may be coupled to each other to form a seam at each interface 268 therebetween. As shown in FIGS. 3 and 4, the sidewalls 126 of the front portion 120 extend a first distance (e.g., first height 262) proximate the upper wall 124, a second distance (e.g., second height 264) proximate the lower section 122, and a third distance (e.g., third height 266) at a midsection therebetween.

In some examples, the first portion 210 and second portion 240 are integrally formed from a single piece of cloth or other flexible and/or pliable material. Alternatively, the first portion 210 and second portion 240 may be formed from separate pieces of cloth and/or other material that are coupled together. The body 242 of the second portion 240 is hingably coupled to the body 212 of the first portion 210 at an interface 270 therebetween such that the front portion 120 of the pack 100 (e.g., fabricated from the second portion 240) may be moved relative to the rear portion 110 of the pack 100 (e.g., fabricated from the first portion 210) between an open position and a closed position. For example, the second portion 240 may be turned and rotated such that an inner surface of the body 242 generally faces an inner surface of the body 212 of the first portion 210 and the end section 244 and/or side sections 246 are generally aligned with the end section 214 and/or side sections 216 of the first portion 210.

In some examples, the end section 244 and/or side sections 246 are selectively coupleable to the end section 214 and/or side sections 216 using a coupling mechanism 130. The coupling mechanism 130 may include, for example, first zipper teeth 282 extending along an edge of the end section 214 and/or side sections 216, second zipper teeth 284 extending along an edge of the end section 244 and/or side sections 246, and one or more zipper sliders 286 (shown in FIG. 1) coupled to the first zipper teeth 282 and/or second zipper teeth 284 for use in connecting the first zipper teeth 282 and second zipper teeth 284 to each other. As shown in FIG. 1, the coupling mechanism 130 may follow an S-shaped path.

FIGS. 3 and 4 show the pack 100 including a control mechanism 310 that selectively controls a movement of the front portion 120 relative to the rear portion 110. The control mechanism 310 is operable independent of the coupling mechanism 130. In some examples, the control mechanism 310 includes a first strap 312 coupled to the rear portion 110, a second strap 314 coupled to the front portion 120, and one or more connectors 316 coupled to the first strap 312 and/or second strap 314 for use in connecting the first strap 312 and second strap 314 to each other. As shown in FIGS. 3 and 4, the first strap 312 and/or second strap 314 may be connected to the rear portion 110 and/or front portion 120 proximate the interface 238 between the upper wall 114 and sidewalls 116 of the rear portion 110 and/or the interface 268 between the upper wall 124 and sidewalls 126 of the front portion 120. In some examples, the connectors 316 include a male quick-release buckle portion and a female quick-release buckle portion that is configured to selectively receive the male quick-release buckle portion. Additionally or alternatively, the control mechanism 310 may include any releasable connection mechanism (e.g., hook-and-loop-type fastener) that allows the pack 100 to function as described herein.

Figure 5:
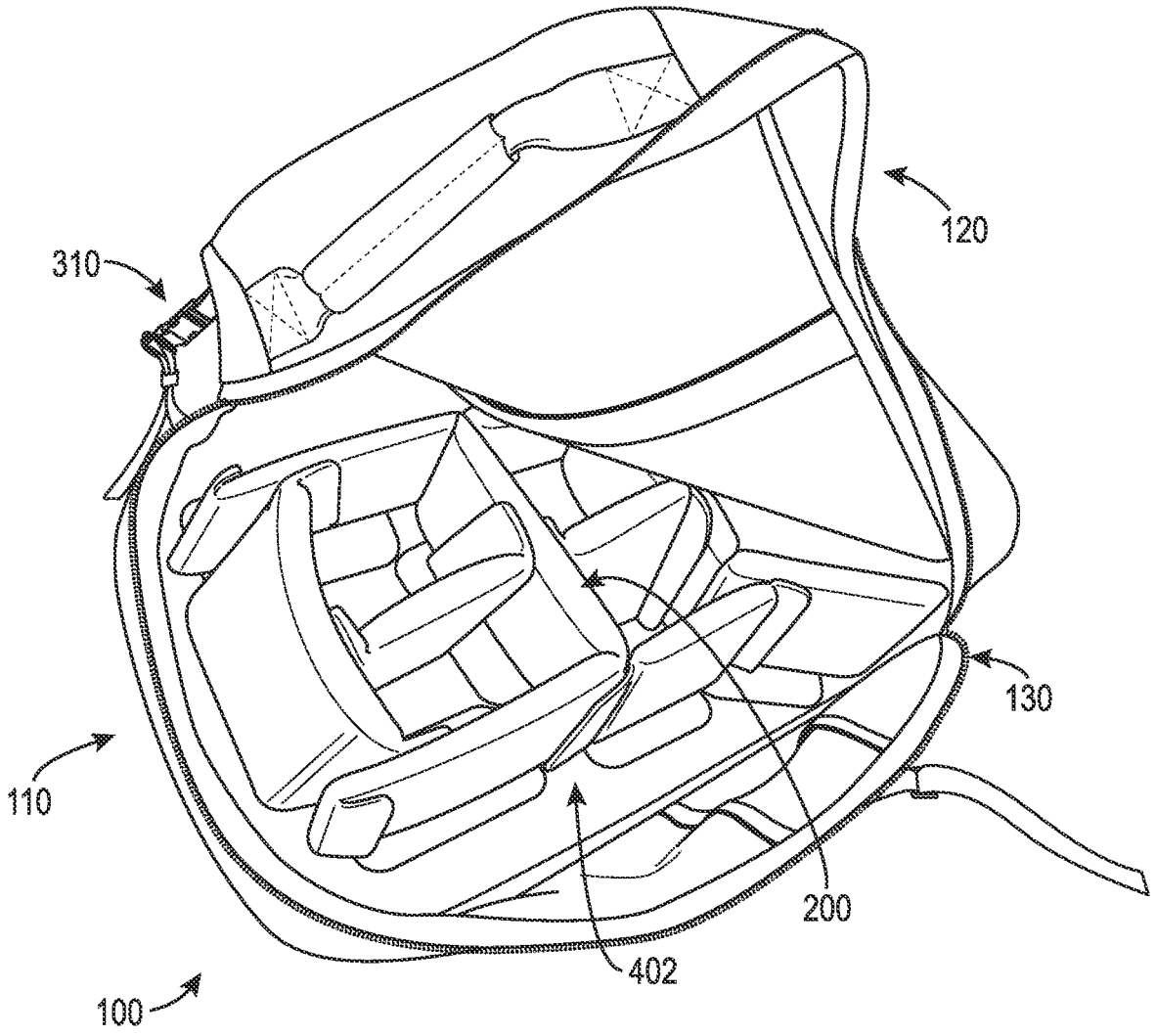
FIG. 5 is a perspective view of the clamshell pack shown in FIG. 1 in a partially open configuration.

The control mechanism 310 may be used to maintain a distance or spacing between at least a section of the front portion 120 and a section of the rear portion 110. A distance between the connectors 316 and the rear portion 110 and/or front portion 120 (e.g., a length of the first strap 312 and/or second strap 314, respectively) may be selectively adjusted to control how tightly the rear portion 110 and front portion 120 would be coupled to each other by the control mechanism 310. For example, the first strap 312 and/or second strap 314 may be adjusted to restrict a movement of the front portion 120 relative to the rear portion 110 while still allowing a section of the front portion 120 to separate from the rear portion 110 to provide access to an interior or cavity 402 of the pack 100 (e.g., when the coupling mechanism 130 is at least partially undone or unzipped), as shown in FIG. 5. In this manner, small sections of the pack 100 may be selectively opened for access to specific areas along the coupling mechanism 130.

Figure 6:
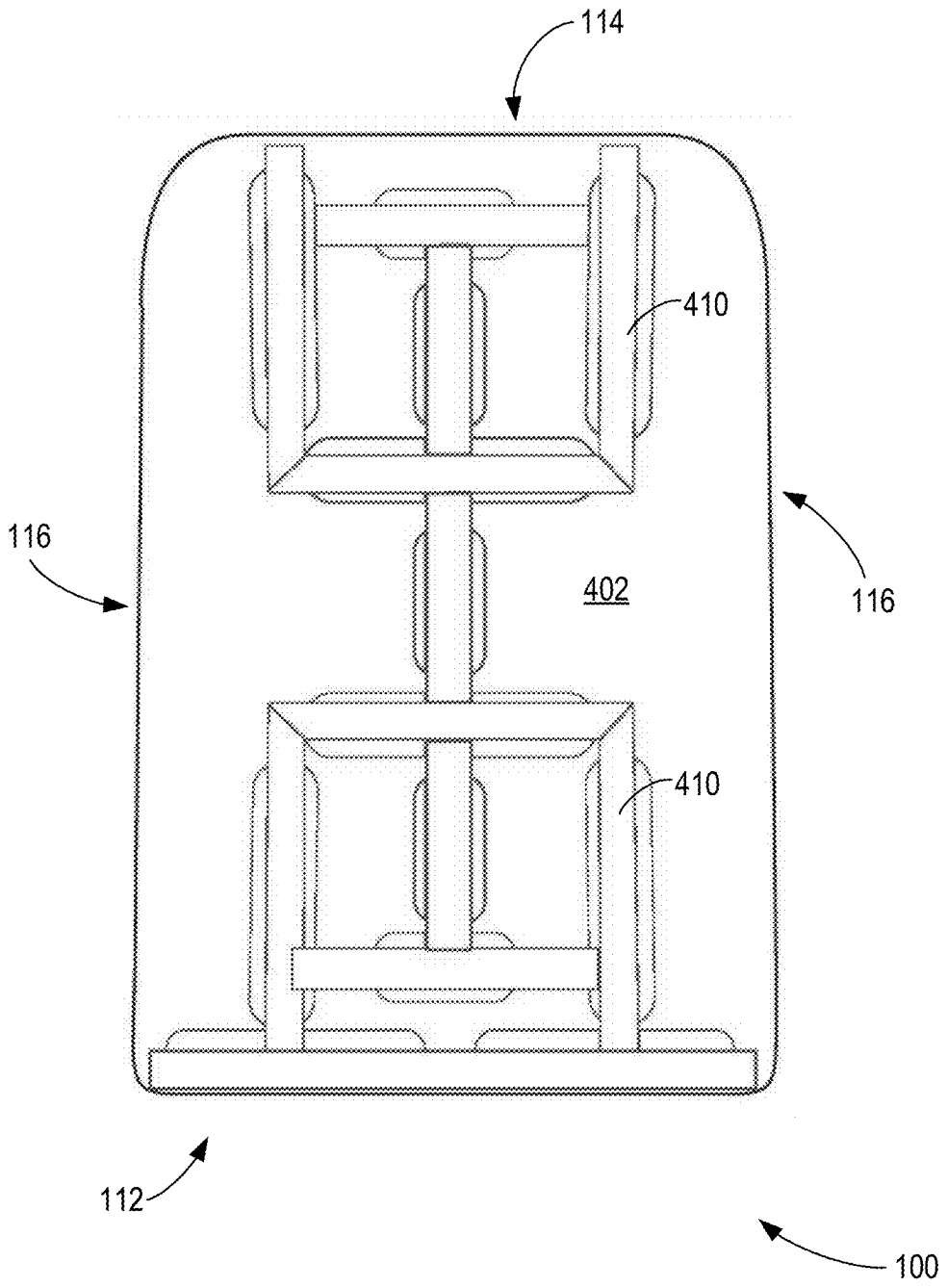
FIG. 6 is a schematic view of an interior of the clamshell pack shown in FIG. 1.

FIG. 6 shows that the pack 100 may be configured to store and/or transport one or more objects (e.g., camera equipment) in the cavity 402. In some examples, the cavity 402 is defined by an inner surface of the lower section 112, upper wall 114, and/or sidewalls 116 of the rear portion 110. As shown in FIG. 6, one or more dividers 410 may be positioned in the cavity 402. To facilitate securing the dividers 410 in the cavity 402, the dividers 410 may be removeably coupled to the inner surface of the lower section 112 and/or sidewalls 116. In some examples, the upper wall 114 is free or spaced from the dividers 410 (e.g., the dividers 410 are not coupled to the upper wall 114).

Figure 8:
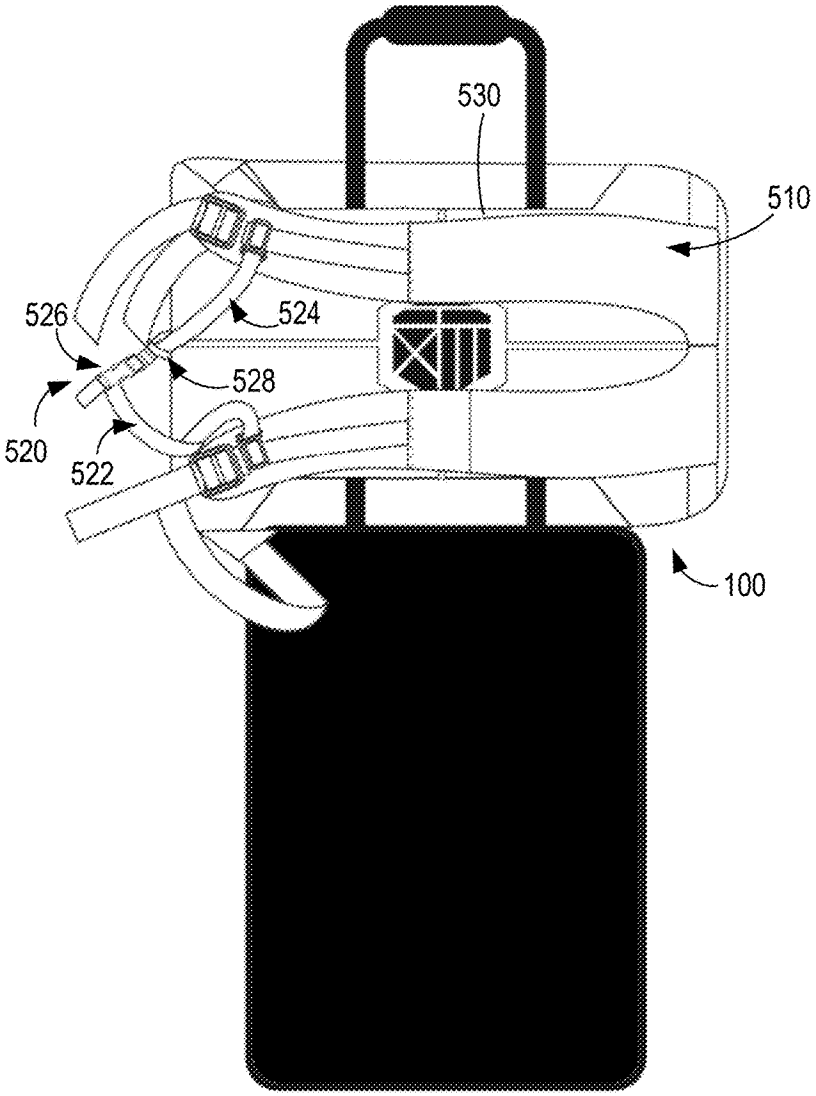
FIG. 8 is a rear view of the clamshell pack shown in FIG. 1 in a second configuration.
Figure 7:
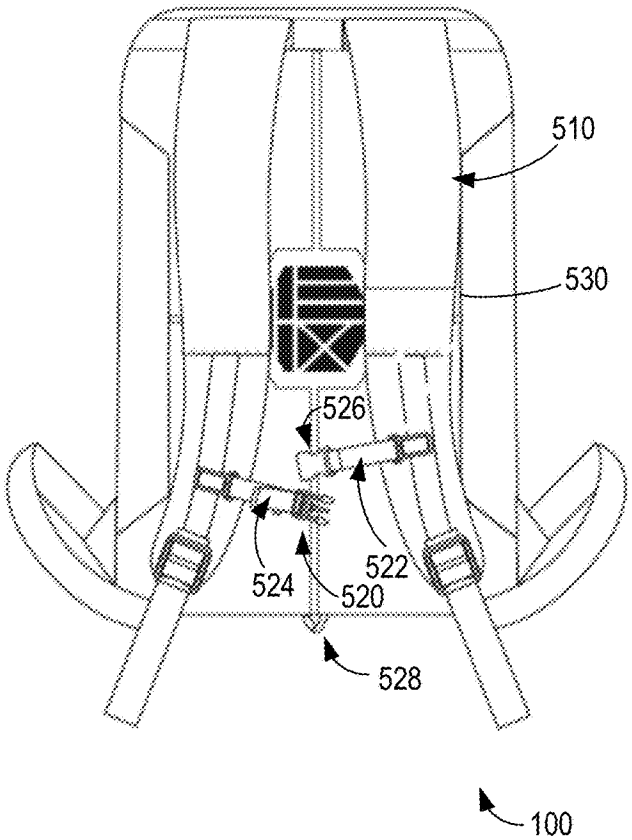
FIG. 7 is a rear view of the clamshell pack shown in FIG. 1 in a first configuration.

As shown in FIGS. 7 and 8, the pack 100 may include one or more shoulder straps 510 that allow the pack 100 to be used as a backpack. The shoulder straps 510 may extend, for example, generally vertically between the lower section 112 and upper wall 114 of the rear portion 110. Alternatively, the shoulder straps 510 may be oriented in any direction and/or coupled to any portion of the pack 100 that allows the pack 100 to function as described herein.

In some examples, the pack 100 includes a securing mechanism 520 that selectively secures the shoulder straps 510. FIG. 7 shows the securing mechanism 520 in a first configuration, and FIG. 8 shows the securing mechanism 520 in a second configuration. The securing mechanism 520 may include, for example, a first strap 522 coupled to one shoulder strap 510, a second strap 524 coupled to another shoulder strap 510, and one or more connectors 526 coupled to the first strap 522 and/or second strap 524 for use in connecting the first strap 522 and second strap 524 to each other. The first strap 522 and/or second strap 524 may slide or translate generally vertically along at least a segment of the shoulder straps 510 to selectively adjust a height or elevation of the first strap 522 and/or second strap 524. In some examples, the connectors 526 include a male quick-release buckle portion and a female quick-release buckle portion that is configured to receive the male quick-release buckle portion. Additionally or alternatively, the securing mechanism 520 may include any releasable connection mechanism (e.g., hook-and-loop-type fastener) that allows the pack 100 to function as described herein.

The securing mechanism 520 may be used to maintain a distance or spacing between the shoulder straps 510. A distance between the connectors 526 and the shoulder straps 510 (e.g., a length of the first strap 522 and/or second strap 524) may be selectively adjusted to control how tightly the shoulder straps 510 would be coupled to each other by the control mechanism 310. For example, the first strap 522 and/or second strap 524 may be adjusted to restrict a movement of the shoulder straps 510 relative to each other. In some examples, the first strap 522 and/or second strap is extended through a loop 528 at the lower section 112 of the rear portion 110 and/or lower section 122 of the front portion 120 to facilitate restricting a movement of the shoulder straps 510 relative to the rear portion 110 and/or front portion 120.

In some examples, the pack 100 includes a panel 530 extending generally parallel to the rear portion 110. The panel 530 may be connected to the lower section 112 and/or upper wall 114 of the rear portion 110, for example, to define a channel therebetween through which a handle 540 may be extended, as shown in FIG. 8.

Figure 9:
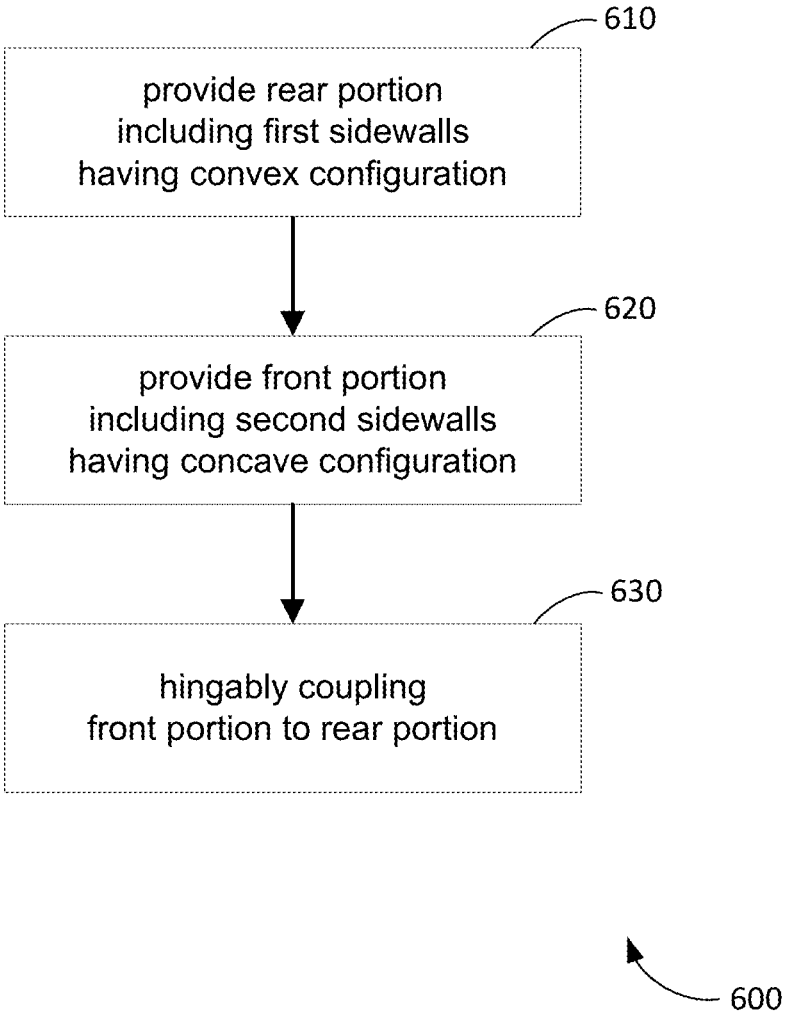
FIG. 9 shows a flowchart of an example method of manufacturing a pack, such as the clamshell pack shown in FIG. 1.

FIG. 9 shows a flowchart of an example method 600 of manufacturing the pack 100. A rear portion 110 is provided at operation 610. The rear portion 110 includes one or more first sidewalls 116. Each first sidewall 116 has a generally convex edge or configuration. In some examples, the rear portion 110 includes an upper wall 114 extending between a pair of first sidewalls 116. The upper wall 114 may have a generally concave edge or configuration such that the rear portion 110 has a first S-shaped edge or configuration.

A front portion 120 is provided at operation 620. The front portion 120 includes one or more second sidewalls 126. Each second sidewall 126 has a generally concave edge or configuration that complements the generally convex edge of the first sidewalls 116. In some examples, the front portion 120 includes an upper wall 124 extending between a pair of second sidewalls 126. The upper wall 124 may have a generally convex edge or configuration that complements the generally concave edge of the upper wall 114 such that the front portion 120 has a second S-shaped edge or configuration that complements the first S-shaped edge of the rear portion 110.

In this manner, the first sidewalls 116 may occupy a majority of the depth of the pack 100 (e.g., at least approximately 60%, at least approximately 70%, or at least approximately 80%, at least approximately 90%) at one or more first locations, including at or proximate to a longitudinal mid-section (e.g., between the lower section 112 and upper wall 114 of the rear portion 110 and/or between the lower section 122 and upper wall 124 of the front portion 120), and the second sidewalls 126 may occupy a majority of the depth of the pack 100 (e.g., at least approximately 60%, at least approximately 70%, or at least approximately 80%, at least approximately 90%) at one or more second locations, including at or proximate to the longitudinal ends (e.g., proximate lower section 112, upper wall 114, lower section 122, and/or upper wall 124).

The front portion 120 is hingably coupled to the rear portion 110 at operation 630. The front portion 120 and rear portion 110 may be coupled such that the pack 100 is moveable between an open configuration and a closed configuration. When the pack 100 is in the closed configuration, the concave edge of the second sidewalls 126 are aligned with or extend generally along the convex edge of the first sidewalls 116.

A control mechanism 310 may be used to selectively control a portion of the front portion 120 and/or rear portion 110 independent of the coupling mechanism 130. For example, when the coupling mechanism 130 is completely undone or unzipped and the front portion 120 is moved from the rear portion 110 to access the cavity 402, the control mechanism 310 may restrict at least a section of the front portion 120 from moving relative to the rear portion 110. In some examples, one section of the front portion 120 may be moved away from the rear portion 110 and/or rotated about the first strap 312 and/or second strap 314 while a distance between another section of the front portion 120 and the rear portion 110 is generally maintained by the first strap 312 and/or second strap 314. Additionally, the concave configuration of the upper wall 124 allow for relatively easy access to the cavity 402, while the concave configuration of the first sidewalls 116 ensure one or more objects are maintained in the cavity 402.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

Examples described herein include a pack that allows for partial opening of the pack to provide useful access to the interior of the pack. For example, the concave configuration of the front upper wall allows for relatively easy access while the concave configuration of the rear sidewalls ensure one or more objects are maintained in the interior of the pack. Some examples include a control mechanism that may be used to selectively control movement of a portion of the front portion and/or rear portion.

When introducing elements of aspects of the disclosure or the embodiments thereof, the articles "a," "an," "the," and "said" are intended to mean that there are one or more of the elements. Furthermore, references to an "embodiment" or "example" of the present disclosure are not intended to be interpreted as excluding the existence of additional embodiments or examples that also incorporate the recited features. The terms "comprising," "including," and "having" are intended to be inclusive and mean that there may be additional elements other than the listed elements. The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, systems, and methods without departing from the scope of aspects of the disclosure, it is intended that all matter contained in the above description and shown in the accompanying drawings shall be interpreted as illustrative and not in a limiting sense.

While the aspects of the disclosure have been described in terms of various examples with their associated operations, a person skilled in the art would appreciate that a combination of operations from any number of different examples is also within the scope of the aspects of the disclosure.

What is claimed is:

1. A pack comprising:

a rear portion including one or more first sidewalls, each first sidewall of the one or more first sidewalls having a generally convex configuration; and a front portion including one or more second sidewalls, each second sidewall of the one or more second sidewalls having a generally concave configuration that complements the generally convex configuration of the one or more first sidewalls, the one or more second sidewalls extendable generally along the one or more first sidewalls to couple the front portion to the rear portion, wherein the rear portion and the front portion are formed from a single piece of cloth.

2. The pack as recited in claim 1, wherein the rear portion includes an upper wall having a generally concave configuration.

3. The pack as recited in claim 1, wherein the front portion includes an upper wall having a generally convex configuration.

4. The pack as recited in claim 1, further comprising a coupling mechanism that selectively couples the one or more second sidewalls to the one or more first sidewalls.

5. The pack as recited in claim 4, wherein the coupling mechanism extends along the one or more first sidewalls and an upper wall of the rear portion.

6. The pack as recited in claim 4, wherein the coupling mechanism extends along the one or more second sidewalls and an upper wall of the front portion.

7. The pack as recited in claim 4, further comprising a control mechanism that selectively controls a movement of the front portion relative to the rear portion, the control mechanism including one or more connectors operable independent of the coupling mechanism.

8. The pack as recited in claim 1, further comprising a control mechanism that selectively controls a movement of the front portion relative to the rear portion, the control mechanism including a pair of straps and one or more connectors configured to connect the pair of straps to each other.

9. The pack as recited in claim 1, further comprising a securing mechanism and a loop coupled to a lower section of one or more of the rear portion or the front portion, the securing mechanism including one or more straps extendable through the loop.

10. The pack as recited in claim 1, wherein the one or more first sidewalls extend generally perpendicular to a body of the rear portion.

11. The pack as recited in claim 1, further comprising one or more dividers positionable in a cavity defined by the one or more first sidewalls and a lower section of the rear portion, the dividers removeably coupleable to an inner surface of the lower section of the rear portion.

12. The pack as recited in claim 11, wherein the rear portion includes an upper wall extending between the one or more first sidewalls, the upper wall free from the one or more dividers.

13. A panel for use in fabricating a pack, the panel comprising:

a first portion including a first body and a pair of first side sections extending laterally from the first body, each first side section of the pair of first side sections having a generally convex configuration; and a second portion hingably coupled to the first portion, the second portion including a second body and a pair of second side sections extending laterally from the second body, each second side section of the pair of second side sections having a generally concave configuration that complements the generally convex configuration of the pair of first side sections, wherein the first portion and the second portion are formed from a single piece of cloth.

14. The panel as recited in claim 13, wherein the first portion includes a first end section having a generally concave configuration, and the second portion includes a second end section having a generally convex configuration that complements the generally concave configuration of the first end section.

15. The panel as recited in claim 13, further comprising a coupling mechanism extending along the pair of first side sections and an end section of the first portion.

16. The panel as recited in claim 13, further comprising a coupling mechanism extending along the pair of second side sections and an end section of the second portion.

17. The panel as recited in claim 13, wherein the pair of first side sections extend generally perpendicular to the first body, and the pair of second side sections extend generally perpendicular to the second body.

18. A method of manufacturing a pack for use in storing camera equipment, the method comprising:

providing a single piece of cloth comprising a rear portion including a pair of first sidewalls and a front portion including a pair of second sidewalls, each first sidewall of the pair of first sidewalls having a generally convex configuration, each second sidewall of the pair of second sidewalls having a generally concave configuration that complements the generally convex configuration of the pair of first sidewalls; and hingably coupling the front portion to the rear portion such that the pack is moveable between an open configuration and a closed configuration, the pair of second sidewalls extending generally along the pair of pair of first sidewalls when the pack is in the closed configuration.

19. The method as recited in claim 18, wherein providing the rear portion includes providing a first upper wall having a generally concave configuration, and providing the front portion includes providing a second upper wall having a generally convex configuration that complements the generally concave configuration of the first upper wall.

* * * * *